US007767076B2

(12) United States Patent
Hokari et al.

(10) Patent No.: US 7,767,076 B2
(45) **Date of Patent: *Aug. 3, 2010**

(54) PROCESS AND APPARATUS FOR TREATING HEAVY OIL WITH SUPERCRITICAL WATER AND POWER GENERATION SYSTEM EQUIPPED WITH HEAVY OIL TREATING APPARATUS

(75) Inventors: Nobuyuki Hokari, Hitachinaka (JP); Tomohiko Miyamoto, Takahagi (JP); Hirokazu Takahashi, Hitachinaka (JP); Hiromi Koizumi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 469 days.

This patent is subject to a terminal disclaimer.

(21) Appl. No.: 11/700,921

(22) Filed: Feb. 1, 2007

(65) Prior Publication Data

US 2007/0144941 A1 Jun. 28, 2007

Related U.S. Application Data

(63) Continuation of application No. 10/245,398, filed on Sep. 18, 2002, now Pat. No. 7,264,710.

(30) Foreign Application Priority Data

Mar. 8, 2002 (JP) ..... 2002-062819

(51) Int. Cl.
*C10G 27/04* (2006.01)

(52) U.S. Cl. ..... 208/253; 208/106; 208/134; 208/308; 208/295; 208/299

(58) Field of Classification Search ..... 208/253, 208/106, 134, 251, 295, 299, 308, 253 R
See application file for complete search history.

(56) References Cited

U.S. PATENT DOCUMENTS

| | | | | |
|---|---|---|---|---|
| 3,733,259 | A | 5/1973 | Wilson et al. | |
| 3,936,371 | A * | 2/1976 | Ueda et al. | 208/251 H |
| 3,948,755 | A | 4/1976 | McCollum et al. | |
| 3,992,876 | A | 11/1976 | Aguet | |
| 4,203,830 | A | 5/1980 | Rollmann et al. | |
| 4,370,223 | A | 1/1983 | Bose | |
| 4,432,890 | A * | 2/1984 | Beck et al. | 502/62 |
| 4,446,012 | A * | 5/1984 | Murthy et al. | 208/130 |
| 6,325,921 | B1 * | 12/2001 | Andersen | 208/253 |
| 6,887,369 | B2 | 5/2005 | Moulton et al. | |

(Continued)

FOREIGN PATENT DOCUMENTS

GB 1 380 106 1/1975

(Continued)

*Primary Examiner*—Ellen M McAvoy
*Assistant Examiner*—Ming Cheung Po
(74) *Attorney, Agent, or Firm*—Dickstein Shapiro LLP

(57) ABSTRACT

The reforming of heavy oil with supercritical water or subcritical water is accomplished by mixing together supercritical water, heavy oil, and oxidizing agent, thereby oxidizing vanadium in heavy oil with the oxidizing agent at the time of treatment with supercritical water and separate vanadium oxide. The separated vanadium oxide is removed by the scavenger after treatment with supercritical water. In this way it is possible to solve the long-standing problem with corrosion of turbine blades by vanadium which arises when heavy oil is used as gas turbine fuel.

5 Claims, 9 Drawing Sheets

U.S. PATENT DOCUMENTS

| | | | | |
|---|---|---|---|---|
| 7,264,710 | B2 * | 9/2007 | Hokari et al. | 208/251 R |
| 2003/0168381 | A1 | 9/2003 | Hokari et al. | |
| 2007/0144941 | A1 | 6/2007 | Hokari et al. | |
| 2008/0099373 | A1 | 5/2008 | Hokari et al. | |

FOREIGN PATENT DOCUMENTS

| | | | |
|---|---|---|---|
| GB | 2 091 758 | A | 8/1982 |
| GB | 2091758 | A * | 8/1982 |
| JP | 11-80750 | | 3/1999 |
| JP | 11-246876 | | 9/1999 |
| JP | 2000-109850 | | 4/2000 |
| JP | 2000-109851 | | 4/2000 |
| JP | 2001-50010 | | 2/2001 |
| JP | 2001303069 | A | 10/2001 |
| JP | 2002-294257 | | 10/2002 |
| JP | 2003090227 | A | 3/2003 |
| JP | 2003097290 | A | 4/2003 |
| JP | 2003184576 | A | 7/2003 |

* cited by examiner

PROCESS AND APPARATUS FOR TREATING HEAVY OIL WITH SUPERCRITICAL WATER AND POWER GENERATION SYSTEM EQUIPPED WITH HEAVY OIL TREATING APPARATUS

This is a continuation of application Ser. No. 10/245,398, filed Sep. 18, 2002 now U.S. Pat. No. 7,264,710, the entire disclosure of which is incorporated herein by reference.

BACKGROUND OF THE INVENTION

The present invention relates to a process and apparatus for treating heavy oil with supercritical water or subcritical water, thereby reforming heavy oil into light oil. More particularly, the present invention relates to a process and apparatus for removing vanadium contained in heavy oil at the time of heavy oil reformation. The present invention relates also to a power generation system which uses heavy oil as fuel for gas turbines.

It has been common practice to drive gas turbines in thermal electric power plants by burning gaseous fuel (such as LNG) or light oil (such as gas oil and kerosene). Gas turbines that run on heavy oil are shunned because they are subject to high temperature corrosion by vanadium contained in heavy oil; therefore, most gas turbines in practical use run on light oil. One way to cope with this situation is to incorporate heavy oil with magnesium as an additive which forms a high-melting composite oxide of magnesium and vanadium, thereby solidifying vanadium in the turbine. (See, for example, "Heavy oil combustion gas turbine", by Nishijima, Journal of Gas Turbine Society of Japan, 11-43, 1983.) The problem involved with this method is that the high-melting composite oxide of magnesium and vanadium (which is called "ash") sticks to turbine blades, making it necessary to suspend operation for blade cleaning. If vanadium is removed while heavy oil is being reformed into gas turbine fuel, then it would be possible to drive gas turbines economically at a low fuel cost.

Reformation of heavy oil into gas turbine fuel is accomplished by use of supercritical water which decomposes and cracks hydrocarbons in heavy oil, thereby yielding combustible gas. Reaction of heavy oil with supercritical water and alkali is also known as a means to remove sulfur components from heavy oil. Processes for reforming heavy oil with supercritical water or subcritical water are disclosed in Japanese Patent Laid-open Nos. 6-279763, 10-310780, 11-80750, 11-166183, 11-246876, 2000-109850, 2000-109851, and 2001-50010.

The prior art techniques mentioned above disclose nothing about the treatment of vanadium contained in heavy oil. If vanadium is removed from heavy oil before heavy oil is introduced into the gas turbine combustor, then it would be unnecessary to solidify vanadium after combustion and hence it would be unnecessary to suspend operation for blade cleaning.

SUMMARY OF THE INVENTION

It is an object of the present invention to provide a process and apparatus for treating heavy oil in such a way that vanadium contained in heavy oil is isolated from heavy oil while heavy oil is being reformed by treatment with supercritical water or subcritical water.

It is another object of the present invention to provide a power generation system which is equipped with said heavy oil treating apparatus so as to obviate the necessity of adding magnesium to gas turbine fuel and the necessity of cleaning turbine blades of ash sticking thereto.

The process according to the present invention consists of mixing together vanadium-containing heavy oil, water, and oxidizing agent, and reacting them under the condition that said water attains the supercritical state or subcritical state, thereby reforming heavy oil and oxidizing vanadium. Vanadium oxide resulting from reaction between vanadium and oxidizing agent is subsequently removed by a vanadium oxide scavenger.

The reaction of heavy oil, water, and oxygen should preferably be carried out at a temperature of 350-600° C. under a pressure of 20-50 MPa. The reaction time should be 10 seconds to 1 hour. The mixing ratio (by volume) of water to heavy oil should be from 0.1:1 to 4:1. The amount of the oxidizing agent should be enough to oxidize vanadium into V2O5. The molar ratio of oxidizing agent to vanadium should be higher than 1.0, and the weight ratio of oxidizing agent to heavy oil should be smaller than 10%.

The oxidizing agent should preferably be at least one species selected from the group consisting of oxygen, air, hydrogen peroxide aqueous solution, nitric acid, and nitrates. The vanadium oxide scavenger should be at least one species selected from the group consisting of iron or iron compounds, calcium or calcium compounds, activated carbon, solid carbon compounds, aluminum oxide, and silicon oxide.

The oxidizing agent may be added to high-temperature high-pressure water in the supercritical state or subcritical state. Alternatively, the oxidizing agent may be added to water which is not in the supercritical state or subcritical state and then water is heated under pressure so that it attains the supercritical state or subcritical state.

According to the present invention, the heavy oil treating process consists of a step of adding an oxidizing agent to high-temperature high-pressure water in the supercritical state or subcritical state, a step of mixing said high-temperature high-pressure water containing said oxidizing agent with vanadium-containing heavy oil, a step of reforming said heavy oil and oxidizing vanadium with said oxidizing agent, and a step of bringing a vanadium oxide scavenger into contact with the reformed oil which contains vanadium oxide resulting from oxidation of vanadium by said oxidizing agent, thereby removing vanadium oxide from said reformed oil.

Alternatively, the heavy oil treating process consists of a step of adding an oxidizing agent to water, a step of mixing said water containing said oxidizing agent with vanadium-containing heavy oil, a step of heating under pressure the mixture of said oxidizing agent, said water, and said heavy oil so that said water attains the supercritical state or subcritical state, thereby reforming said heavy oil and oxidizing vanadium, and a step of bringing a vanadium oxide scavenger into contact with the reformed oil which contains vanadium oxide resulting from oxidation of vanadium by said oxidizing agent, thereby removing vanadium oxide from said reformed oil.

According to the present invention, the heavy oil treating apparatus has a reactor for reacting heavy oil with high-temperature high-pressure water in the supercritical state or subcritical state, thereby reforming said heavy oil and yielding reformed oil, wherein the reactor is provided with an oxidizing agent supplying unit to supply an oxidizing agent thereto and is also provided with a vanadium oxide capturing unit to bring a vanadium oxide scavenger into contact with said reformed oil discharged from said reactor, thereby removing vanadium oxide contained in said reformed oil.

Alternatively, the heavy oil treating apparatus has a reactor for reacting heavy oil with water in the supercritical state or subcritical state, thereby reforming said heavy oil, a water supplying pipe to supply water in the supercritical state or subcritical state to said reactor, a heavy oil supplying pipe to supply heavy oil to said reactor, an oxidizing agent adding apparatus to add an oxidizing agent to water in the supercritical state or subcritical state flowing in said water supplying pipe, and a vanadium oxide capturing unit to bring a vanadium oxide scavenger into contact with the treated product discharged from said reactor, thereby removing vanadium oxide contained in said treated product.

The heavy oil treating apparatus of the present invention may be of multi-tubular type consisting of a plurality of reactors and have a vanadium oxide capturing apparatus into which the treated product discharged from said reactors is introduced to remove vanadium oxide. This construction is desirable for efficient treatment. More than one set of such apparatus may be installed.

The present invention is directed also to a power generation system which comprises having the heavy oil treating apparatus constructed as mentioned above in part of the fuel supply system and producing electric power in such a way that said heavy oil treating apparatus supplies reformed fuel to a combustor, which evolves combustion gas, which is supplied to a gas turbine, which drives a generator connected thereto.

The power generation system also comprises a waste heat recovering boiler to recover waste heat from exhaust gas discharged from said gas turbine, thereby raising the water temperature, and piping to supply part of high-temperature high-pressure water or steam evolved by said waste heat recovering boiler to said reactor of said heavy oil treating apparatus.

The feature of the present invention is that vanadium is released from cyclic hydrocarbon compounds or porphyrin structure in heavy oil by means of supercritical water or subcritical water which functions as an organic solvent. The reaction to remove vanadium is promoted by an oxidizing agent added to the reaction system.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

Figure 5:
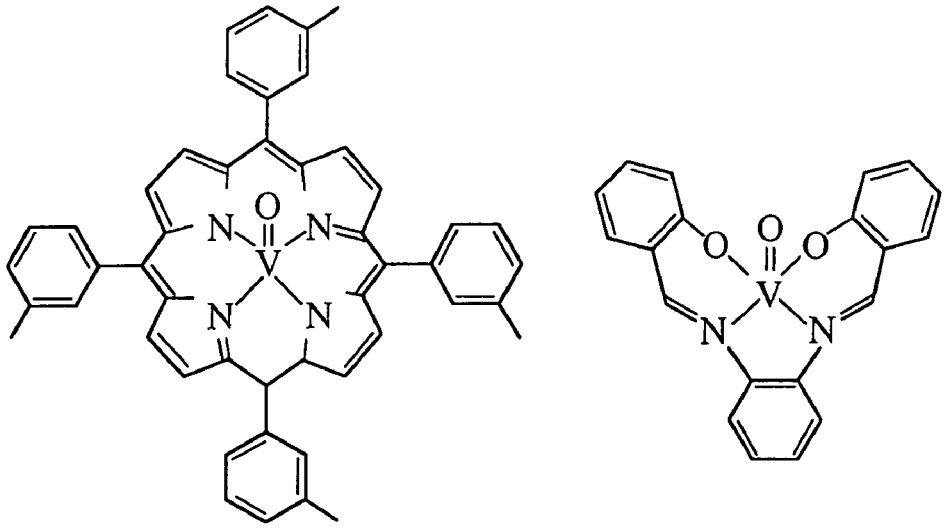
FIG. 5 is a diagram showing one example of vanadium compound in heavy oil.

Vanadium in heavy oil exists in the form of porphyrin complex or cyclic organic compound as shown in FIG. 5. (Fish, R. H., Komlenic, J. J., Anal. Chem. 1984, 56(3), p. 510-517). High-temperature high-pressure water in the supercritical state or subcritical state disperses organic molecules into supercritical water or subcritical water which has a solvent action, and also decomposes organic molecular chains through hydrolysis. However, supercritical water or subcritical water alone does not decompose vanadium compounds in organic molecules. Vanadium is not decomposed by alkali. This is different from the desulfurizing reaction according to the conventional technique.

Figure 6:
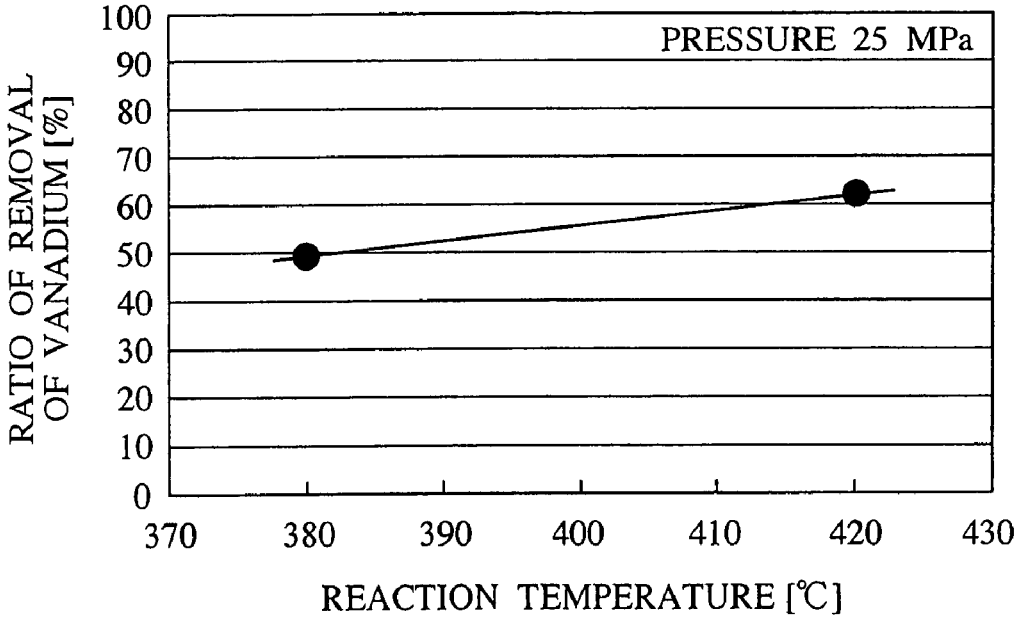
FIG. 6 is a diagram showing a result of the experiment on removal of vanadium from heavy oil.

According to the present invention, heavy oil is mixed with high-temperature high-pressure water in the supercritical state or subcritical state and then the resulting mixture is incorporated with an oxidizing agent. This procedure releases vanadium from organic molecules by decomposition. FIG. 6 shows the ratio of vanadium removed which is achieved when heavy oil, water, and hydrogen peroxide aqueous solution are reacted together at a high temperature under a high pressure. It is noted that the ratio of vanadium removed increases as the temperature increases. Presumably, the removal of vanadium involves the following reactions that take place simultaneously. (1) Partial oxidation of organic hydrocarbons. (2) Generation of hydrogen by shift reaction between CO and water. (3) Attack of CO to oxygen in organic molecules. (4) Cleavage of organic molecule chains by hydrogen and water. (5) Oxidation of vanadium by the oxidizing agent. These reactions decompose vanadium in organic molecules and releases vanadium in the form of vanadium oxide.

The vanadium oxide (V2O5) resulting from the above-mentioned reactions is removed from the reformed oil by adsorption or reaction with a scavenger. Adsorption of vanadium oxide may be accomplished by physical adsorption with activated carbon or by chemical adsorption with an inorganic compound used for catalyst production. Since vanadium oxide reacts with a metal such as calcium and iron to give a composite oxide, these metals can be used as a scavenger to remove vanadium from heavy oil. Once caught by the scavenger, the resulting solid is discharged from the system and then separated into vanadium and scavenger to be recycled.

Figure 8:
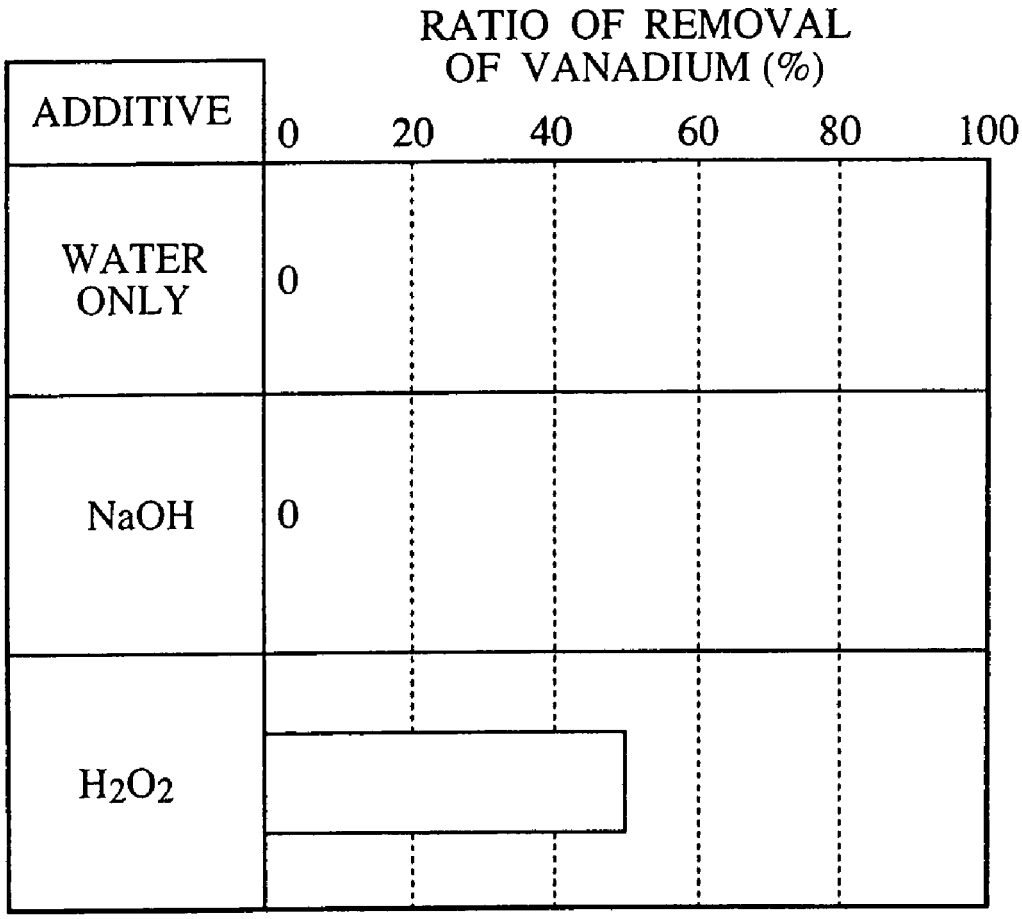
FIG. 8 is a diagram showing the effect of additives on the ratio of removal of vanadium from heavy oil.

FIG. 8 shows the effect of supercritical water on the ratio of vanadium removed from heavy oil.

The results were obtained by experiments under the following conditions. Temperature: 420° C., pressure: 25 MPa, water/oil ratio: 1.0, amount of vanadium in heavy oil: 20 ppm, and concentration of additive: 1%. It is noted that hydrogen peroxide produces a remarkable effect of removing vanadium.

First Embodiment

Figure 1:
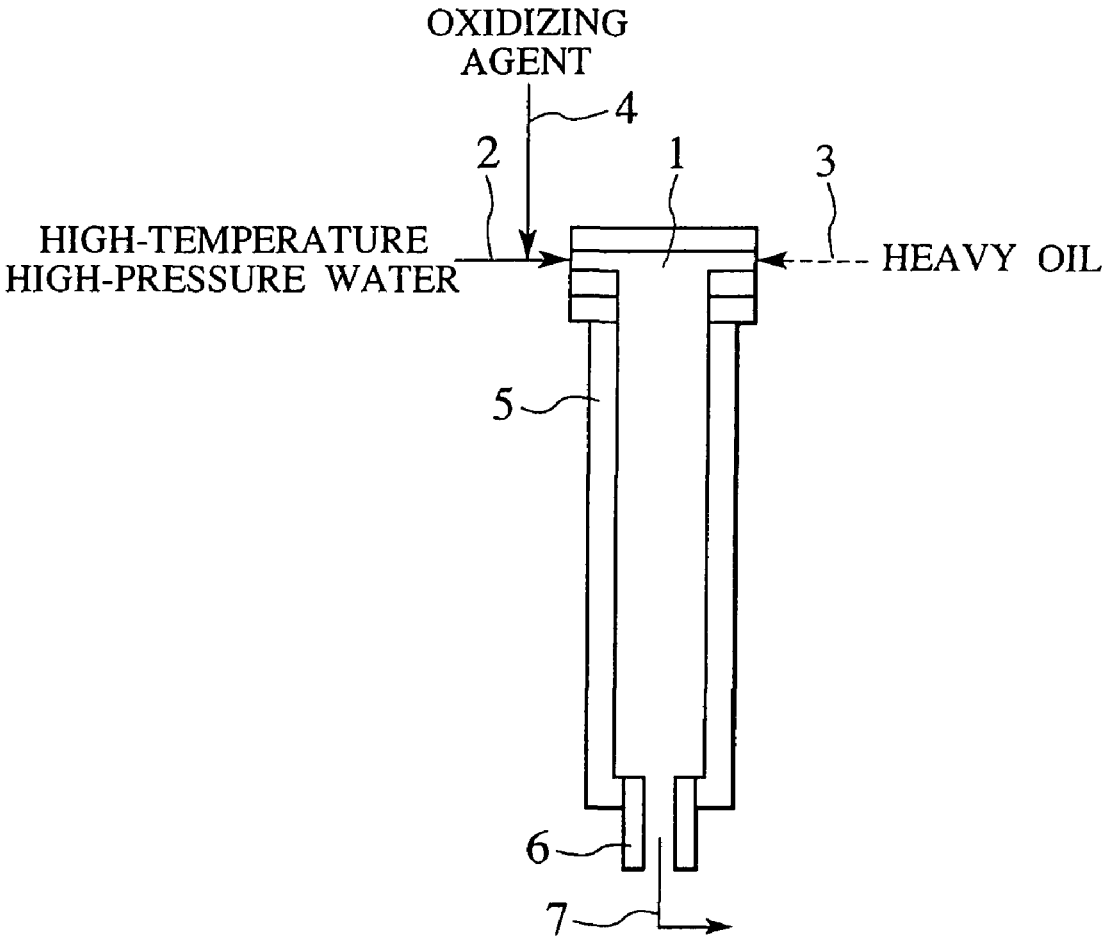
FIG. 1 is a schematic diagram showing one embodiment of the heavy oil reforming apparatus used in the present invention.

FIG. 1 shows a part of the heavy oil treating apparatus according to the present invention. This part is designed for heavy oil reformation. The mixer 1 (for water, heavy oil, and oxidizing agent) functions as the inlet of the treating apparatus. To the mixer 1 are connected a water supply pipe 2 to supply high-temperature high-pressure water, a heavy oil supply pipe 3 to supply heavy oil, and an oxidizing agent supply pipe 4 to supply an oxidizing agent to high-temperature high-pressure water flowing in the water supply pipe 2.

The mixer 1 mixes together water and heavy oil by the solvent action of supercritical water or subcritical water. The resulting mixed fluid is sent to the reactor 5. The mixing of high-temperature high-pressure water, heavy oil, and oxidizing agent may be accomplished by any of simple confluence method, circular flow method, and countercurrent method. An alternative construction is permissible in which the mixer 1 is omitted and the reactor 5 is supplied directly with high-temperature high-pressure water, heavy oil, and oxidizing agent.

Figure 7:
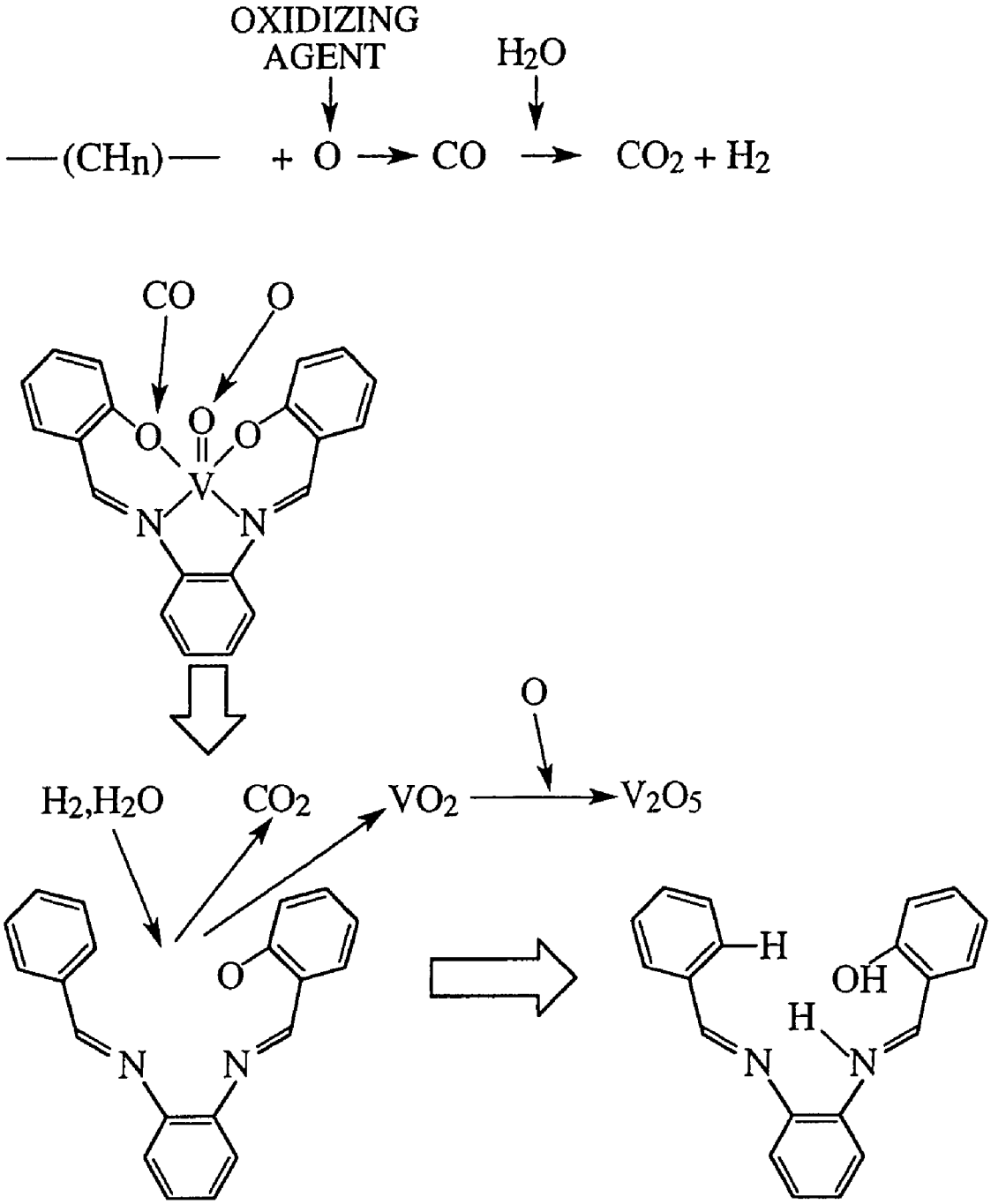
FIG. 7 is a diagram showing the possible mechanism of reaction to remove vanadium from heavy oil.

The reactor 5 permits reactions (shown in FIG. 7) to proceed so that vanadium in heavy oil is released from organic molecule. For these reactions to proceed, it is necessary to keep the entire system at a prescribed temperature and pressure. One way to achieve this object is to supply previously heated and pressurized water as in this embodiment. The other way is to supply the mixer 1 or the reactor 5 with water and heavy oil and heat and pressurize them later. Reactions in the reactor 5 give rise to reformed fuel containing released vanadium oxide (fluid 7), which is discharged from the outlet 6 (for reformed fuel oil).

Figure 2:
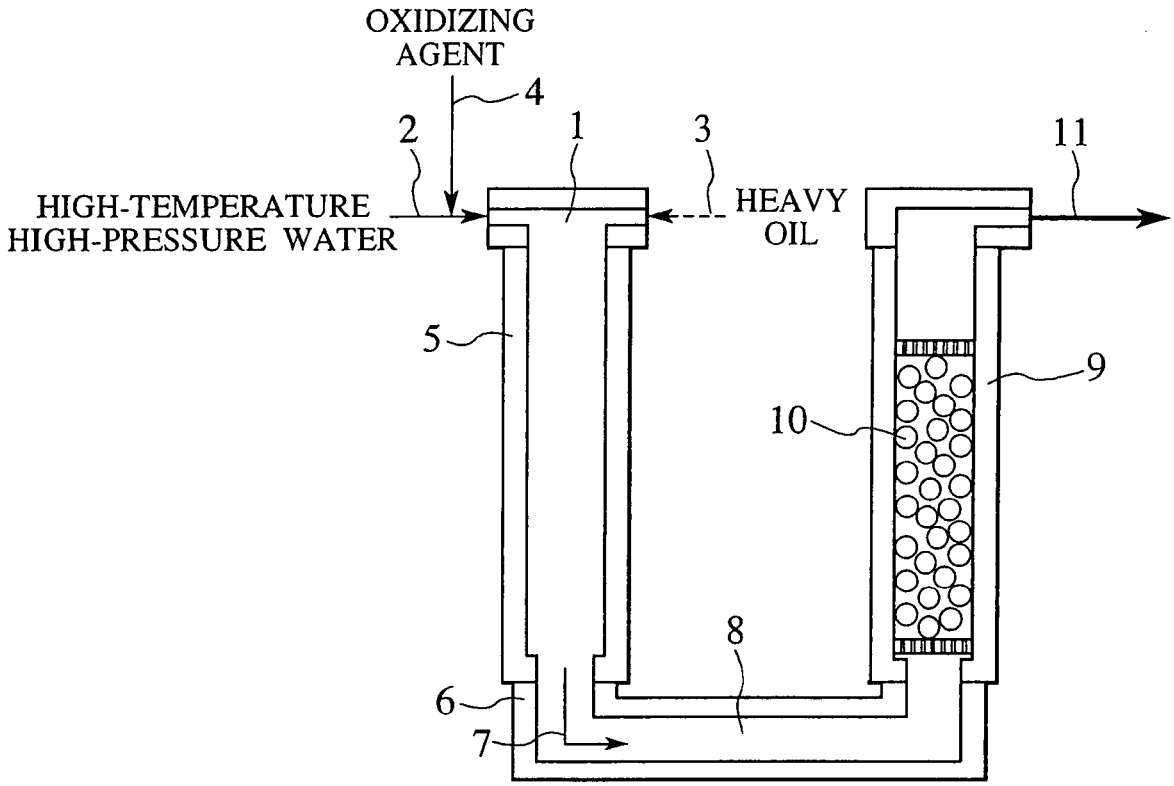
FIG. 2 is a schematic diagram showing one embodiment of the heavy oil treating apparatus according to the present invention.

FIG. 2 shows another embodiment of the heavy oil treating apparatus according to the present invention in which the apparatus shown in FIG. 1 is supplemented with a system to remove vanadium oxide from reformed fuel.

The fluid containing reformed fuel and released vanadium oxide (fluid 7) leaves from the outlet 6, passes through the connecting pipe 8, and enters the vanadium oxide catcher 9 in which vanadium oxide is separated. An alternative construction is permissible in which the connecting pipe 8 is omitted and the reactor 5 is connected directly to the vanadium oxide catcher 9. The vanadium oxide catcher 9 is filled with the vanadium oxide scavenger 10 to catch vanadium oxide. The vanadium oxide scavenger 10 collects vanadium oxide from the fluid 7 by adsorption or reaction. The vanadium oxide catcher 9 collects only vanadium oxide and discharges almost all hydrocarbons as reformed fuel 11.

The vanadium oxide scavenger 10 is held as a fixed bed or fluidized bed in the vanadium oxide catcher 9. In the former case, the vanadium oxide scavenger may be fixed to the grating; in the latter case, the vanadium oxide scavenger may be formed into pellets with an adequate diameter matching the terminal velocity (which is larger than the linear velocity of the fluid 7). Alternatively, the vanadium oxide scavenger may take on a platy or honeycomb form through which the fluid 7 passes. The vanadium oxide catcher 9 may be provided with a system to discharge used vanadium oxide scavenger or to replenish fresh vanadium oxide scavenger because the vanadium oxide scavenger 10 becomes gradually less effective with time. Alternatively, the reactor 5 may be equipped with more than one vanadium oxide catcher 9 so that the catchers are switched sequentially or the catchers are partly suspended at a certain interval.

Second Embodiment

Figure 3:
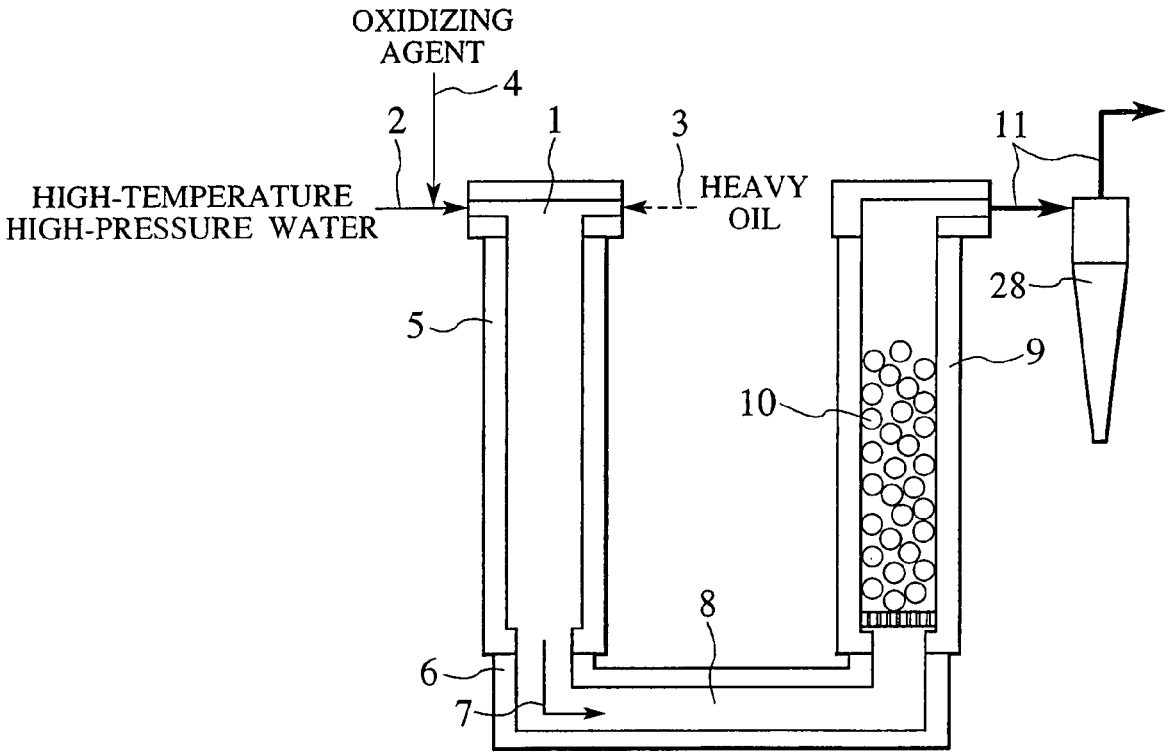
FIG. 3 is a schematic diagram showing another embodiment of the heavy oil treating apparatus according to the present invention.

FIG. 3 shows another heavy oil treating apparatus according to the present invention. This apparatus is identical to that shown in FIG. 2 in the structure covering the reactor 5 to the vanadium oxide catcher 9. With vanadium oxide removed by the vanadium oxide catcher 9, the reformed fuel 11 is discharged as shown in FIG. 3. The outlet of the vanadium oxide catcher 9 is provided with a particle collector 28 of cyclone type to collect the vanadium oxide scavenger in particulate form which might be present in the reformed fuel 11. The particle collector 28 may be replaced by a filter. Alternatively, the particle collector 28 may be provided with a means to return the collected vanadium oxide scavenger 10 to the vanadium oxide catcher 9.

Third Embodiment

Figure 9:
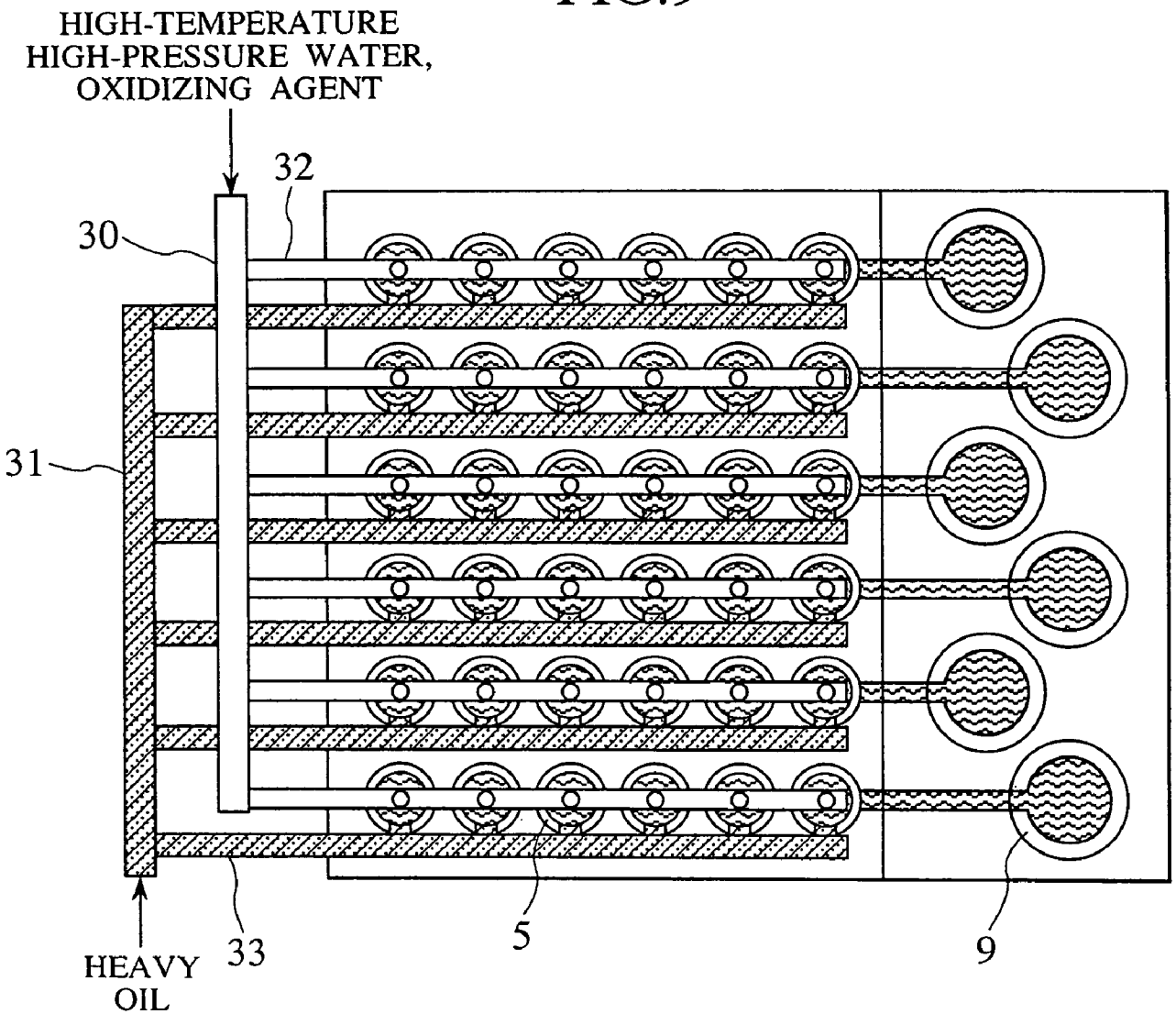
FIG. 9 is a plan view of the heavy oil treating apparatus in another example of the present invention.
Figure 10:
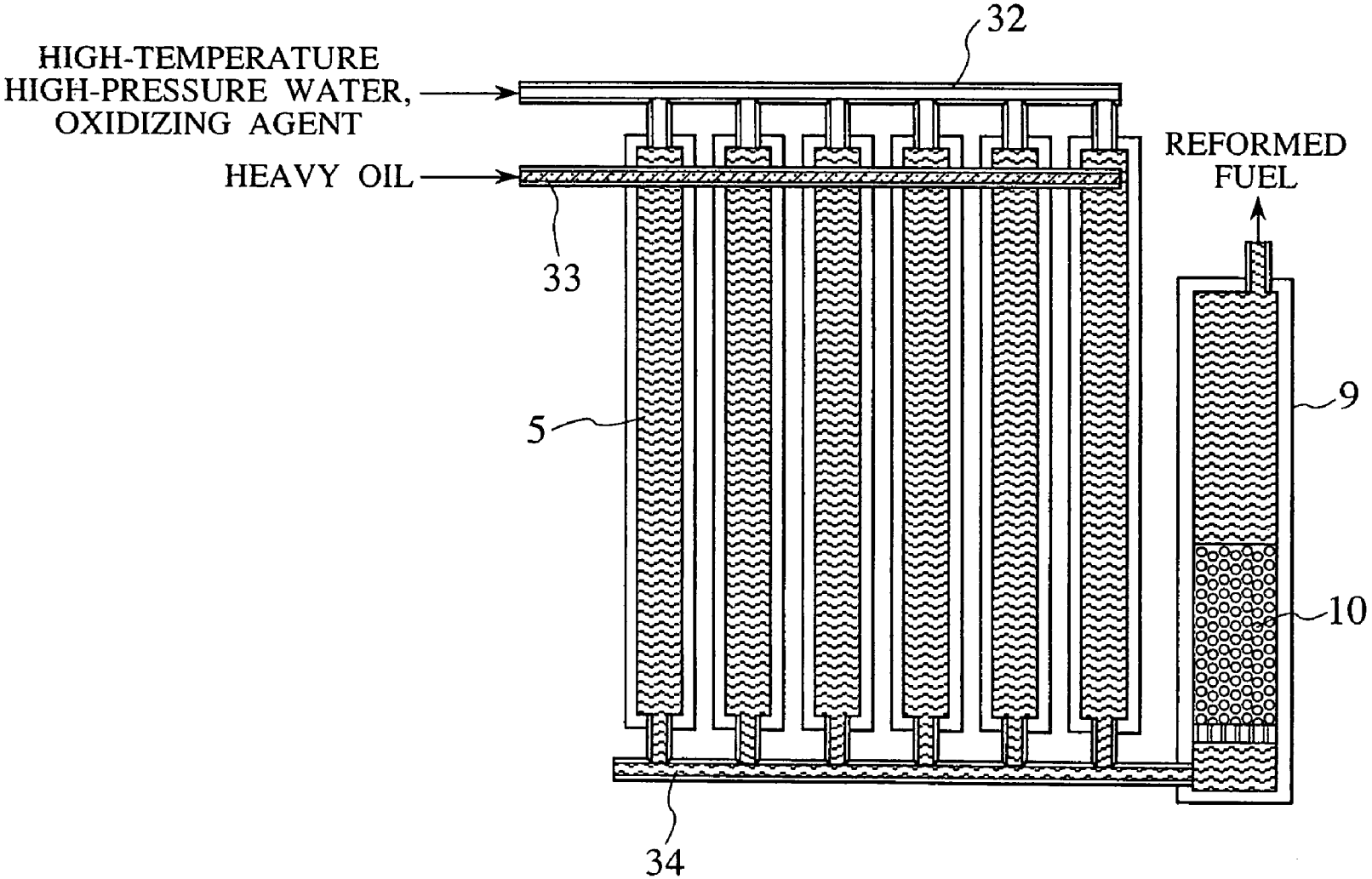
FIG. 10 is a side elevation of the heavy oil treating apparatus in another example of the present invention.

FIGS. 9 and 10 show further another heavy oil treating apparatus according to the present invention. FIG. 9 is a plan view and FIG. 10 is a side elevation.

The apparatus in this embodiment is characterized in having a plurality of tubular reactors 5. The reactors 5 are supplied with a mixture of oxidizing agent and high-temperature high-pressure water through the manifold 30. The manifold 30 branches into a plurality of branch pipes 32 to which the reactors 5 are connected. In the case shown in FIGS. 9 and 10, six reactors are connected to each branch pipe. As shown in FIG. 10, the mixture of oxidizing agent and high-temperature high-pressure water which has been introduced into the branch pipe 32 enters the top of each of the six reactors.

On the other hand, heavy oil is introduced into the manifold 31. The manifold 31 branches into a plurality of branch pipes 33 to which the reactors 5 are connected. Thus, heavy oil introduced into one branch pipe 33 is distributed into a plurality of rectors. As shown in FIG. 10, the heavy oil enters the top of the reactor 5.

Each branch pipe 32 supplies high-temperature high-pressure water and oxidizing agent to the six reactors, and each branch pipe 33 supplies heavy oil to the six reactors. The heavy oil is reformed in the reactors, and the treated product is discharged from the bottom of the reactor and introduced into the manifold 34. The treated product is subsequently introduced into the vanadium oxide catcher 9 for removal of vanadium oxide.

According to this embodiment, it is possible to treat a large amount of heavy oil efficiently at one time. Thus the system of this embodiment is of great practical use.

Fourth Embodiment

Figure 4:
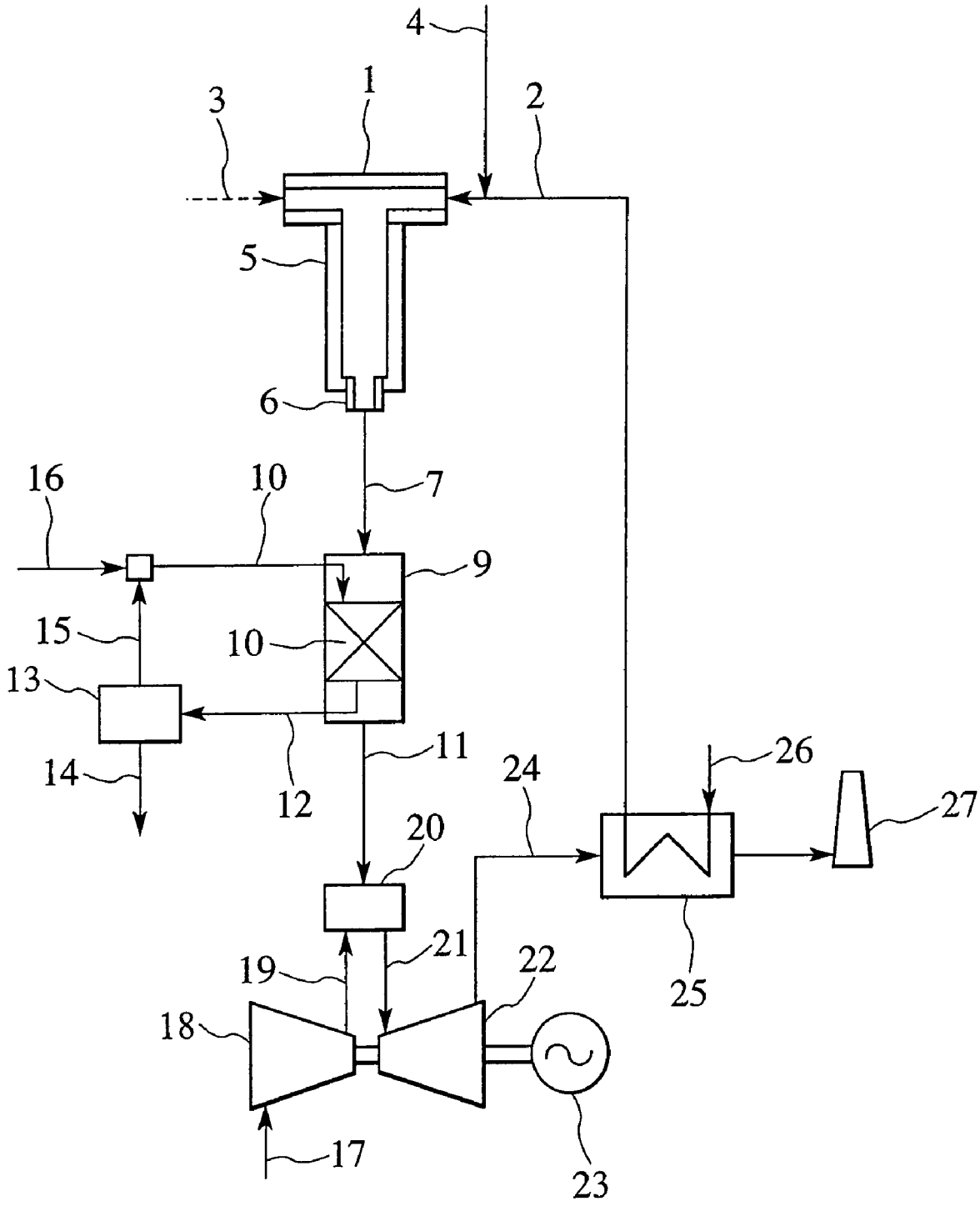
FIG. 4 is a schematic diagram showing one embodiment of the gas turbine power generation system to which is connected the heavy oil treating apparatus of the present invention.

FIG. 4 shows a gas turbine power generation system which is equipped with the heavy oil treating apparatus of the present invention. In the first and second embodiments, it is assumed that the reformed fuel 11 is stored or transported for use at power generation plants. This embodiment is designed such that the reformed fuel is immediately burned in the combustor 20 of the power generation system.

As in the first and second embodiments, the mixer 1 mixes together high-temperature high-pressure water, heavy oil, and oxidizing agent, the reactor 5 oxidizes vanadium into vanadium oxide for separation from heavy oil, and the vanadium oxide catcher 9 captures vanadium oxide from reformed fuel 11 with the aid of vanadium oxide scavenger 10. The used scavenger 12 is partly removed before the action of the vanadium oxide scavenger 10 becomes saturated. The used scavenger 12 which has been removed is sent to the scavenger cleaner 13 in which the scavenger is refreshed by cleaning and reaction to remove vanadium oxide. The refreshed scavenger 15 is recycled to the scavenger supply system. At this time, new scavenger 16 is added to replenish the loss by reaction and returned to the vanadium oxide catcher 9. In this embodiment, one each of the reactor 5 and the vanadium oxide catcher 9 are installed; however, more than one each of the reactor 5 and the vanadium oxide catcher 9 may be installed so as to ensure an adequate residence time for the reaction of the fuel to be supplied to the gas turbine combustor 20 and the capture of vanadium oxide. The reformed fuel is burned in the combustor 20 with the aid of air 19 compressed by the compressor 18. The combustion gas 21 drives the turbine 22 connected to the dynamo 23 for power generation.

The gas turbine exhaust gas 24 discharged from the gas turbine transfers heat to water 26 in the exhaust gas heat exchanger 25 and generates high-temperature high-pressure water which is returned to the reactor 5 through the water supply pipe 2. Finally, the gas turbine exhaust gas is discharged from the chimney stack 27. Utilization of heat of exhaust gas from the gas turbine improves the efficiency of the system.

This embodiment may be modified such that exhaust gas recovery boiler are installed before and after the exhaust gas heat exchanger 25, as in the conventional gas turbine compound power generation system, so that steam thus generated drives a steam turbine to generate electric power. In addition, the system in this embodiment may be supplemented with a denitrating unit to remove nitrogen oxide evolved at the time of combustion in the gas turbine combustor or with a desulfurizing unit to remove sulfur oxide evolved at the time of combustion. In this embodiment, vanadium in heavy oil is removed by the vanadium oxide catcher 9, so that there is no possibility of the gas turbine undergoing high-temperature corrosion. Therefore, it is not necessary to add an additive like magnesium to form composite oxides with vanadium. In this way it is possible to prevent metal oxide ash from sticking to turbine blades, thereby permitting continuous operation as in the case of the gas turbine system which runs on light oil fuel. This leads to a high plant operation rate and efficient power generation.

This embodiment solves the problem with corrosion of the gas turbine by vanadium oxide which was encountered in the conventional heavy oil combustor.

According to the present invention, it is possible to separate vanadium from heavy oil in the reforming of heavy oil with supercritical water or subcritical water. Vanadium oxide isolated from reformed oil is captured by the vanadium oxide scavenger. Thus, according to the present invention, it is possible to solve the long-standing problem with corrosion of turbine blades by vanadium which arises when heavy oil is used as gas turbine fuel.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A heavy oil treating process including a step of reforming heavy oil by reaction of heavy oil with supercritical water or subcritical water, which comprises:

mixing vanadium-containing heavy oil with water containing an oxidizing agent;

heating and pressurizing said water so that it attains the supercritical state or subcritical state;

reforming said heavy oil;

reacting said vanadium and said oxidizing agent;

producing vanadium oxide resulting from oxidation of said vanadium by said oxidizing agent; and subsequently capturing and removing the resulting vanadium oxide.

2. A heavy oil treating process as defined in claim 1, wherein the reforming and oxidation reaction are carried out at a temperature of 350-600° C. and under a pressure of 20-50 Mpa.

3. A heavy oil treating process as defined in claim 1, wherein said oxidizing agent is at least one species selected from the group consisting of oxygen, air, hydrogen peroxide aqueous solution, nitric acid, and nitrates.

4. A heavy oil treating process as defined in claim 1, wherein reformed oil containing said vanadium oxide is introduced into a vanadium oxide capturing unit, thereby removing said vanadium oxide from said reformed oil.

5. A heavy oil treating process as defined in claim 4, wherein said vanadium oxide capturing unit comprises at least one species selected from the group consisting of iron or iron compounds, calcium or calcium compounds, activated carbon, solid carbon compounds, aluminum oxide, and silicon oxide.

* * * * *